US008215113B2

(12) United States Patent
Hudson et al.

(10) Patent No.: US 8,215,113 B2
(45) **Date of Patent: *Jul. 10, 2012**

(54) PEDESTAL MOUNTED TURBOCHARGER SYSTEM FOR INTERNAL COMBUSTION ENGINE

(75) Inventors: Anthony William Hudson, Highland, MI (US); Patrick Sexton, Ypsilanti, MI (US); Christopher Kelly Palazzolo, Ann Arbor, MI (US); Christopher Cowland, Dexter, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 979 days.

This patent is subject to a terminal disclaimer.

(21) Appl. No.: 12/145,830

(22) Filed: Jun. 25, 2008

(65) Prior Publication Data

US 2009/0320470 A1 Dec. 31, 2009

(51) Int. Cl.
*F02G 3/00* (2006.01)
*F02B 33/44* (2006.01)

(52) U.S. Cl. ..... 60/624; 60/605.3

(58) Field of Classification Search ..... 184/6.11, 184/6.16; 60/605.3; 123/195; 277/591, 277/594, 596, 598, 637
See application file for complete search history.

(56) References Cited

U.S. PATENT DOCUMENTS

| | | | | |
|---|---|---|---|---|
| 4,405,138 | A * | 9/1983 | Skrycki | 277/591 |
| 4,469,078 | A * | 9/1984 | Speer et al. | 123/564 |
| 4,483,147 | A * | 11/1984 | Evans et al. | 60/611 |
| 4,583,367 | A * | 4/1986 | Kapfer et al. | 60/605.3 |
| 4,643,137 | A | 2/1987 | Choushi | |
| 4,716,735 | A * | 1/1988 | Ruf et al. | 60/605.3 |
| 5,079,921 | A | 1/1992 | McCandless | |
| 5,139,349 | A | 8/1992 | Nakano | |
| 5,392,604 | A * | 2/1995 | Nikula et al. | 60/605.3 |
| 5,392,751 | A * | 2/1995 | Matsubara et al. | 123/559.1 |
| 5,544,486 | A * | 8/1996 | Lu | 60/599 |
| 6,125,799 | A | 10/2000 | Van Son | |
| 6,305,168 | B1 * | 10/2001 | Furukawa | 60/605.1 |
| 6,484,683 | B2 | 11/2002 | Zielke | |
| 6,915,634 | B2 * | 7/2005 | Dumas et al. | 60/605.3 |
| 7,043,915 | B2 * | 5/2006 | Anello | 60/605.3 |
| 7,165,402 | B2 * | 1/2007 | Blom | 60/605.3 |
| 7,784,442 | B2 * | 8/2010 | Lester et al. | 123/193.5 |
| 7,810,466 | B2 * | 10/2010 | Preimesberger et al. | 123/195 A |
| 2001/0048062 | A1 | 12/2001 | Murao | |
| 2005/0257521 | A1 | 11/2005 | Anello | |
| 2007/0056281 | A1 * | 3/2007 | Arvan et al. | 60/598 |
| 2007/0175456 | A1 | 8/2007 | Tally | |
| 2007/0234997 | A1 | 10/2007 | Prenger | |
| 2009/0078240 | A1 * | 3/2009 | Diggs et al. | 123/559.1 |
| 2009/0095875 | A1 * | 4/2009 | Anello | 248/637 |
| 2009/0320469 | A1 * | 12/2009 | Palazzolo et al. | 60/624 |

FOREIGN PATENT DOCUMENTS

| | | | |
|---|---|---|---|
| DE | 10218354 | A1 | 11/2003 |
| GB | 2424450 | A | 9/2006 |

* cited by examiner

*Primary Examiner* — Thomas Denion
*Assistant Examiner* — Cameron Setayesh
(74) *Attorney, Agent, or Firm* — Julia Voutyras; Alleman Hall McCoy Russell & Tuttle LLP

(57) ABSTRACT

A turbocharger system for an internal combustion engine includes a turbocharger with a utility pedestal extending between the turbocharger and a mounting surface associated with the engine. The utility pedestal includes a mounting pad for attaching the combined turbocharger and pedestal assembly to the engine, as well as internal oil and coolant supply passages for supplying the turbocharger with coolant and lubricating oil under pressure.

18 Claims, 7 Drawing Sheets

PEDESTAL MOUNTED TURBOCHARGER SYSTEM FOR INTERNAL COMBUSTION ENGINE

CROSS REFERENCE TO RELATED APPLICATIONS

None.

BACKGROUND OF THE INVENTION

1. Field of the Invention

The present invention relates to a turbocharger system including not only a turbocharger, but also a mounting pedestal configured with internal utilities needed to operate and position the turbocharger.

2. Related Art

Turbocharging has been used for a number of years with internal combustion engines. Although early turbochargers were often cooled primarily by air, as well as by the flow of oil through the turbocharger's bearings, later model turbochargers, especially larger turbochargers and those installed in heavy duty engines, generally utilize coolant circulating from the engine's cooling system through the turbo, and then back to the engine's main cooling system. Of course, turbochargers also require an oil supply and drain utilities to lubricate the bearings associated with the turbocharger. Needless to say, the provision of a source of coolant and a source of oil, with both being under pressure, as well as draining the oil and coolant from the turbocharger and returning these fluids separately to the engine, has necessitated a good deal of external plumbing. Unfortunately, external fluid connections and associated pipes and hoses cause problems because hoses and fittings are known to leak and are subject to damage which may be accelerated by the high temperatures prevailing within engine compartments. Moreover, aside from durability issues, the need for external plumbing for turbochargers increases the space required by the turbocharger in an already crowded underhood environment. U.S. Pat. No. 6,125,799 discloses a turbocharger mounting arrangement using a bulky mix of internal and external utility plumbing to mount twin turbochargers upon the extreme ends of an engine.

Turbochargers mounted on engines typically consume a good deal of space for another reason. Because known mounting arrangements are not susceptible to locating the turbocharger close to the engine block, turbochargers must be spaced away from the engine to permit the insertion and removal of the turbochargers' fasteners. Moreover, known turbocharger mounting systems increase radiated noise because of a lack of rigidity and because of the dimensional problems associated with their usage.

It would be desirable to provide a turbocharger, including a mounting system having a pedestal with internal and integral supply and return passages for coolant and lubricating oil.

BRIEF DESCRIPTION OF THE INVENTION

According to an aspect of the present invention a turbocharger system for an internal combustion engine having a cylinder block includes a turbocharger and a utility pedestal extending between the turbocharger and a hard point associated with the cylinder block. The utility pedestal includes a mounting pad for the pedestal and an oil supply passage for conveying lubricating oil under pressure from the cylinder block to the turbocharger. A return oil passage conveys lubricating oil from the turbocharger to a lubrication system incorporated within the engine. A coolant supply passage conveys coolant under pressure to the turbocharger, and a coolant return passage, configured at least in part within the utility pedestal, conveys coolant from the turbocharger to a cooling system incorporated within the engine. According to another aspect of the present invention, the coolant return passage may include a passage configured, at least in part, within the engine's cylinder block, as well as within the utility pedestal.

According to another aspect of the present invention a coolant return passage from the turbocharger may be configured so as to convey the coolant to a mixing chamber within which the coolant from the turbocharger is mixed with coolant flowing from at least one cylinder head.

According to another aspect of the present invention, a return oil passage from the turbocharger conveys waste oil from the turbocharger to a crankcase sump without allowing the waste oil to contact moving parts within the engine.

According to another aspect of the present invention, a hard point associated with the cylinder block for mounting the turbocharger includes a generally planar mounting pad configured on a portion of the cylinder block, with the mounting pad of the utility pedestal having a lower mating surface matched to the generally planar mounting pad. The cylinder block's mounting pad is configured with lubricating oil and coolant utilities.

According to another aspect of the present invention, a turbocharger's generally planar mounting pad may be configured upon a cylinder block within a valley defined by the cylinder banks of a V-block engine.

According to yet another aspect of the present invention, the turbocharger pedestal mounting pad of the utility pedestal comprises a number of mounting bosses having fastener bores extending therethrough at an acute angle with respect to horizontal plane such that fasteners inserted within the bores pass inboard to threaded bores formed in the hard point associated with the cylinder block.

According to another aspect of the present invention, the return, or waste, oil passage extending from the turbocharger and through the utility pedestal is designed to prevent foamed or frothed oil flowing from the turbocharger from impairing engine lubrication. This is accomplished by preventing the waste oil from contacting moving parts within the engine as the oil flows back to the crankcase sump.

It is an advantage of the present turbocharger system that the turbocharger and pedestal may be assembled at one geographic location and installed upon an engine as a single unit at a second geographic location without the need for making external utility connections for lubricating oil and water feeds and drains.

It is another advantage of a turbocharging system according to the present invention that the turbocharger system, including the turbocharger and the utility pedestal, with its oil and coolant utilities, is compact and ideally suited for mounting in the valley of a V-block internal combustion engine.

It is yet another advantage of a turbocharging system according to the present invention that the noise signature of the turbocharger will be reduced because of the stiffness inherent with the close mounted utility pedestal featured in the present invention.

It is yet another advantage of the present invention that the lubricating oil and coolant supply and drain passages required for a turbocharger are routed internally within the present utility pedestal.

Other advantages, as well as features of the present invention, will become apparent to the reader of this specification.

DETAILED DESCRIPTION OF THE PREFERRED EMBODIMENTS

Figure 1:
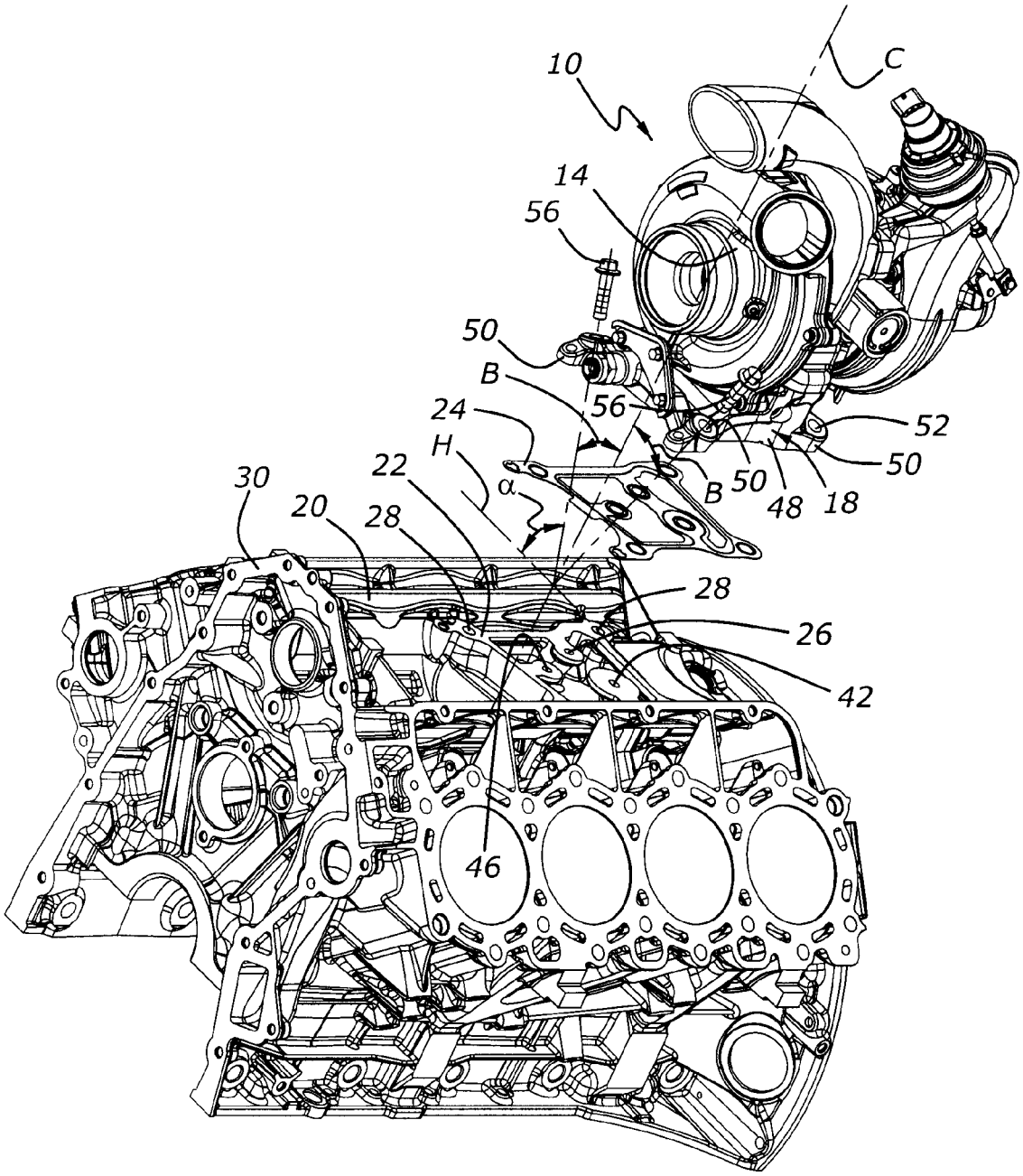
FIG. 1 is an exploded perspective view of an engine having a turbocharger system according to the present invention.
Figure 6:
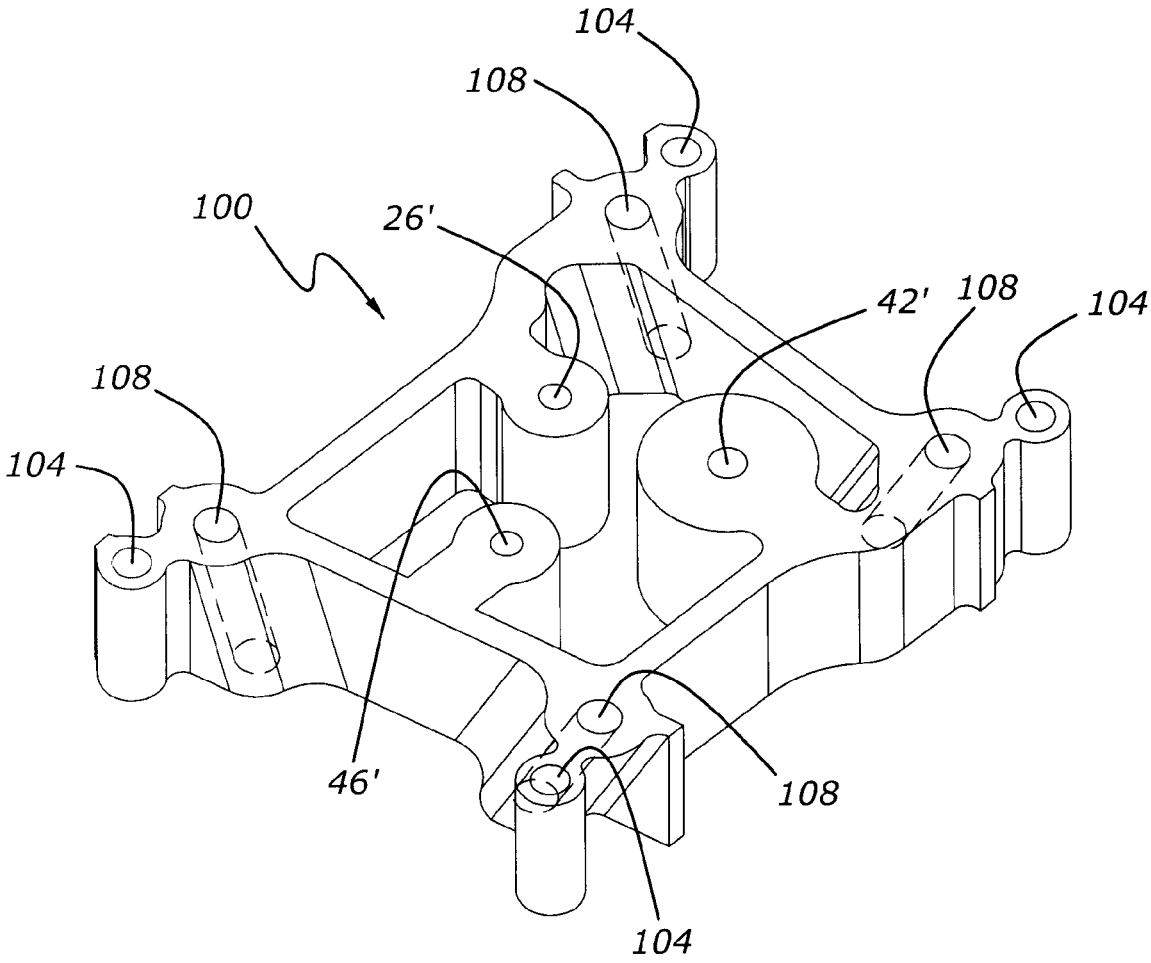
FIG. 6 is a perspective view of a turbocharger mounting hard point configured as a plate suitable for bolting or welding to an engine cylinder block.

As shown in FIG. 1, turbocharger system 10 includes a turbocharger, 14, and a utility pedestal, 18. Turbocharger 14 is preferably mounted to utility pedestal 18 before turbocharger 14 is mounted upon an engine. FIG. 1 also shows an engine cylinder block, 30, having a valley, 20, into which turbocharger system 10 is placed upon a hard point, which is illustrated as generally planar mounting pad 22. Utility pedestal 18 provides rigid structural support for turbocharger 14; this helps to reduce unwanted engine noise emissions, as well as reducing unwanted vibration associated with the turbocharger. Those skilled in the art will appreciate in view of this disclosure that the term "hard point", as used herein means either a structurally rigid mounting location such as block pad machined into the parent metal of a cylinder block, or a separate pad, such as that illustrated at 100 in FIG. 6. Mounting pad 100 is intended to be attached to an engine by bolting, or welding, or by some other suitable process.

Figure 2:
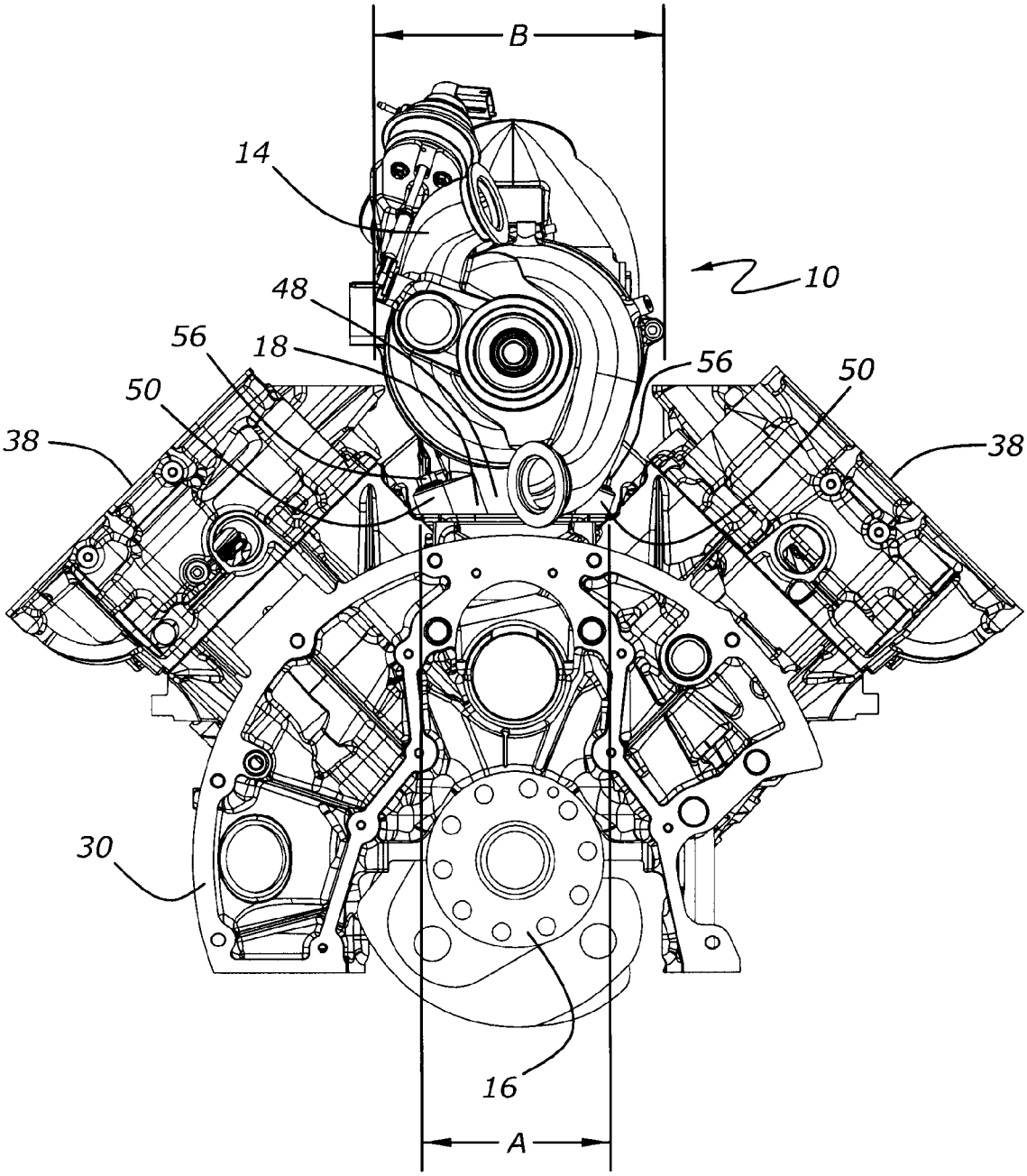
FIG. 2 is an end view, partially cut away, of a portion of an engine having a turbocharger system according to the present invention.

Utility pedestal 18 has a mounting pad, 48, at its lower extremity. Mounting pad 48 includes mounting bosses 50, which have fastener bores 52. Fastener bores 52 extend through mounting bosses 50 and make an acute angle, $\alpha$, with a horizontal plane, H (FIG. 1). Fastener bores 52 allow the passage of a number of threaded fasteners, 56, which pass through fastener bores 52 and into threaded bores, 28, formed in generally planar mounting pad 22 of cylinder block 30. Two of threaded bores 28 are shown in FIG. 1. FIG. 1 further shows that mounting bosses 50 are angled so that threaded fasteners or bolts 56 extend inboard into bolt holes 28 formed in mounting pad 22 of cylinder block 30. This geometry is also shown in FIG. 2. In the event that a separate mounting pad is employed, such as that illustrated at 100 in FIG. 6, a number of fastener bores, 108, will be provided in the same manner as bores 52. Pad 100 also contains fluid passages 26', 42', and 46', which perform the functions ascribed below to passages 26, 42, and 46, respectively. Pad 100 may be fastened to an engine by means of threaded fasteners extending through bores 104, or, as noted above, by welding, brazing, or other known methods.

As seen in FIG. 2, the width, A, of utility pedestal mounting pad 48 is less than the overall width, B, of turbocharger 14. This is an added benefit stemming from the angular orientation of fastener bores 52, which fortuitously permit turbocharger 14 and utility pedestal 18 to be disassembled as one unit from the engine without removing portions of the turbocharger assembly. The angles of fastener bores 52 also allow turbocharger 14 to be mounted closer to cylinder block 30, in a vertical direction closer to crankshaft 16. FIG. 2 shows turbocharger 14 nestled in valley 20 between cylinder heads 38 and cylinder block 30.

Figure 3:
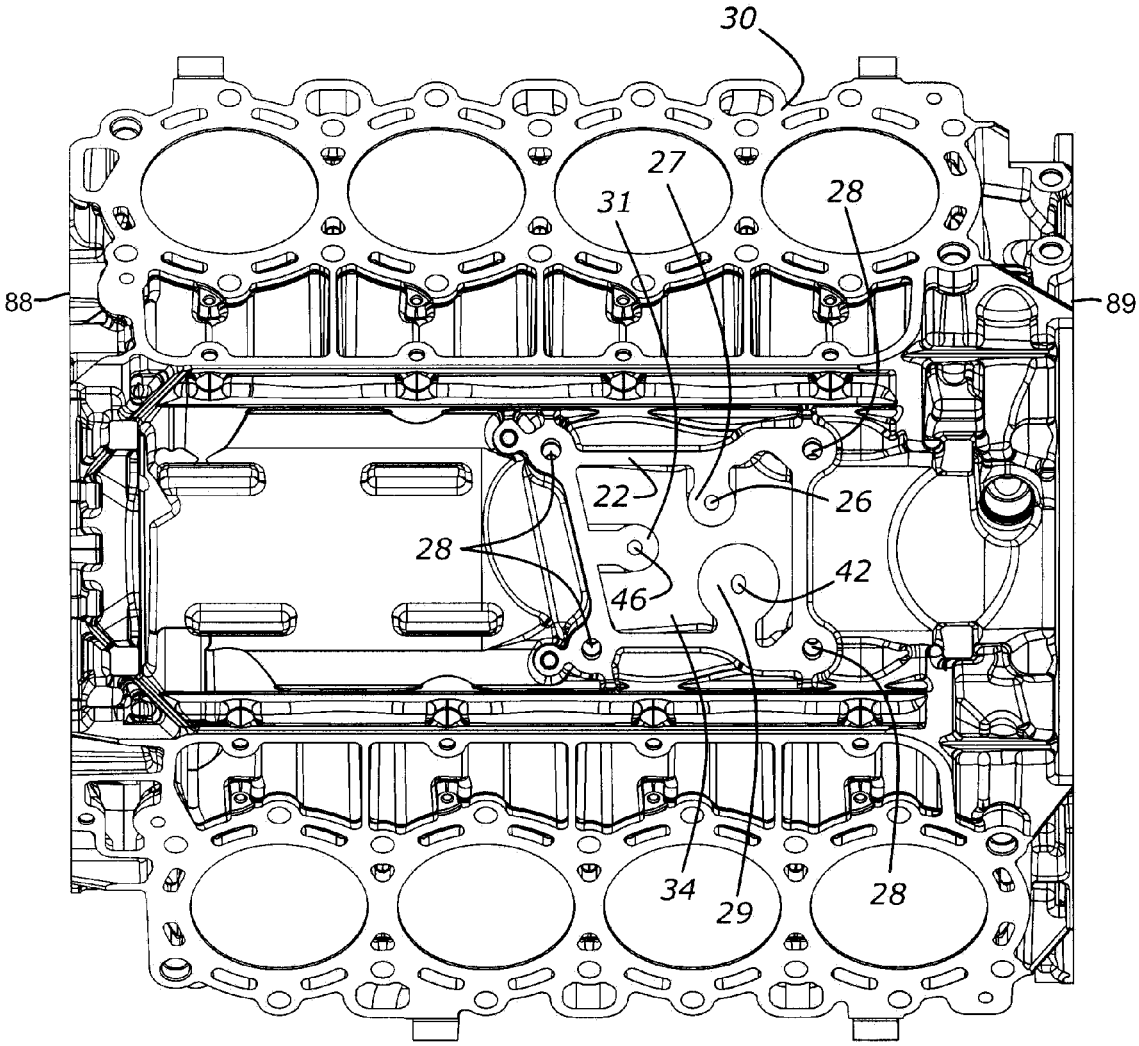
FIG. 3 is a plan view of an engine block showing a turbocharger pedestal mounting pad and utility passages for lubricating oil and coolant according to an aspect of the present invention.

FIG. 3 shows generally planar mounting pad 22 as being located in the mid-portion of the valley of cylinder block 30 between block end walls 88, 89. Several of threaded mounting bolt holes 28 are shown. FIG. 3 further illustrates several utilities for turbocharger 14. The first such utility, oil supply passage 26, is shown as terminating in a port formed within the planar surface of mounting pad 22. Coolant supply passage 42 also communicates with this surface, as does coolant return 46. In other words, portions of oil supply passage 26, coolant supply passage 42, and coolant return passage 46 are all co-planar with the uppermost surface of mounting pad 22. As a result, all of these utilities may be sealed to utility pedestal 18 with a single gasket 24, which is shown in FIG. 1. Gasket 24 is illustrated as a unitary carrier incorporating a number of integral o-rings for sealing passages 26, 42, and 46.

Figure 4:
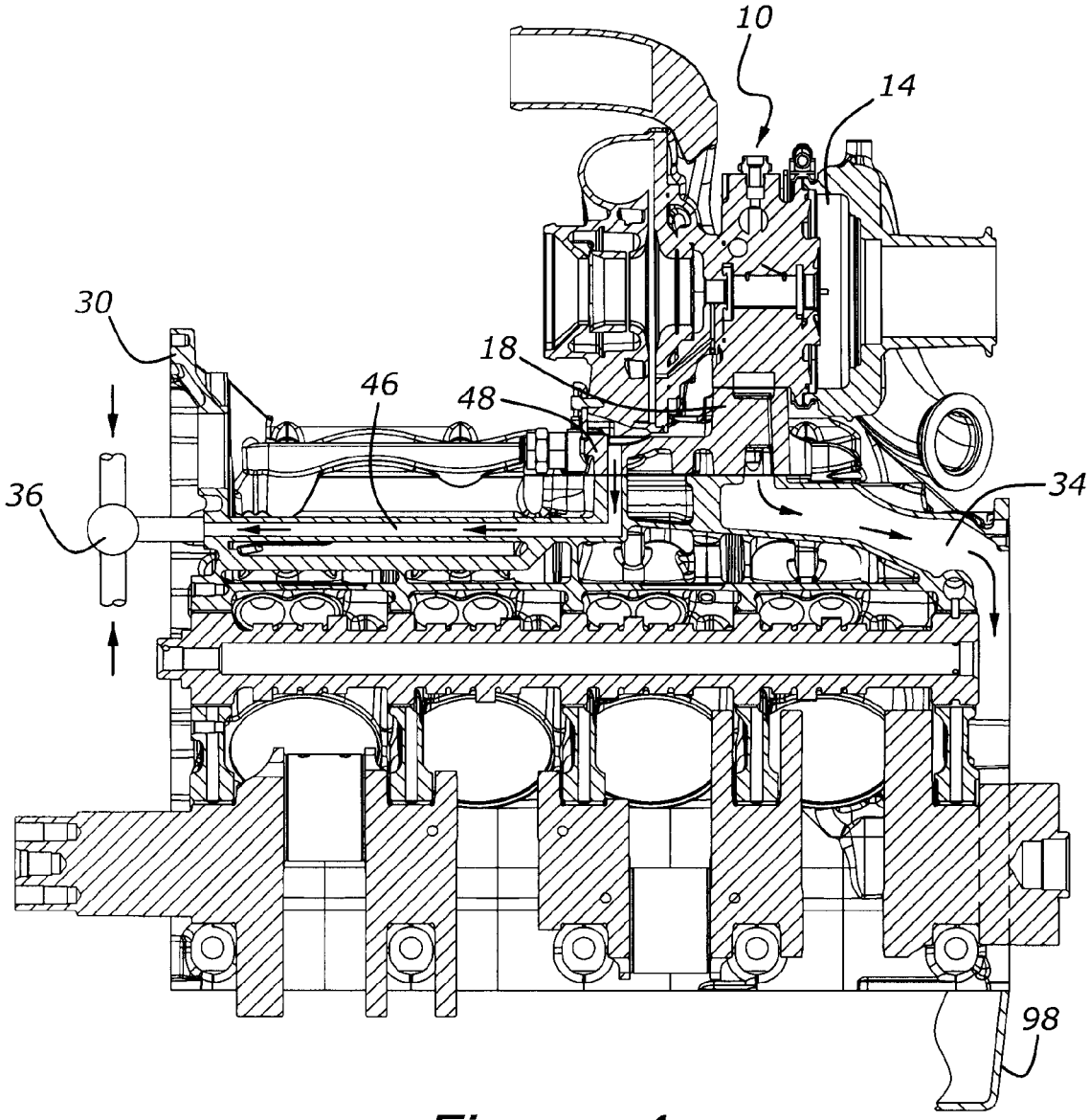
FIG. 4 is a side elevation, partially cut away, of an engine having a turbocharger system according to the present invention and showing the routing for several of the utility passages for oil and water according to the present invention.

Only the uppermost part of return oil isolation passage 34 within cylinder block 30 is shown in FIG. 3; for more definition, one must look to FIG. 4, wherein return oil passage 34 is shown as leading to one end of engine block 30 and down into crankcase sump 98 through a region in which there are no rotating or moving parts. As noted above, the drainback of waste oil from turbocharger 14 to crankcase sump 98 through areas of the engine devoid of moving parts prevents galling or overheating of such moving parts by preventing contact between temporarily aerated oil and parts needing lubrication.

Figure 5:
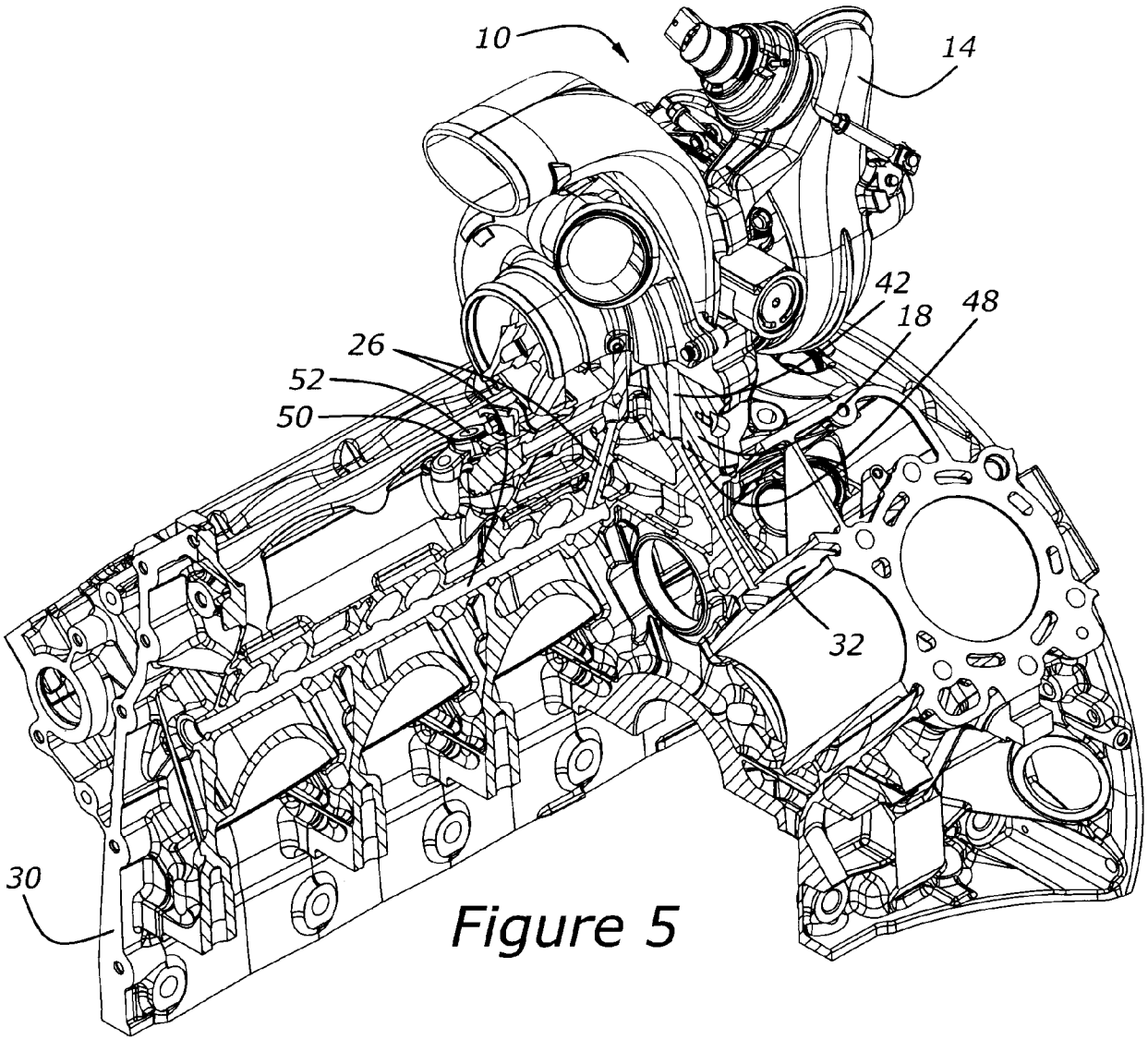
FIG. 5 is a side perspective view, partially cut away, of an engine having a turbocharger system according to the present invention.

FIGS. 4 and 5 show oil supply internal passage 26 extending up into utility pedestal 18 from within cylinder block 30. Further, FIG. 5 shows coolant supply internal passage 42, which extends into utility pedestal 18 from an engine water jacket, 32. Water leaving turbocharger 14 flows through coolant return internal passage 46 down through utility pedestal 18 and out to the front of engine block 30, wherein the flow is joined with coolant flow from one or more cylinder heads at a combination point 36. Coolant return passage 46 may advantageously be configured as a cored passage within cylinder block 30. Those skilled in the art will appreciate in view of this disclosure that combination point 36 could be configured as a water outlet or coolant surge tank or other device for combining coolant flows from more than one source, such as one or more of the engine's cylinder heads. This combination of flows offers the advantage of mitigating coolant temperature excursions which could otherwise result from the very warm coolant leaving turbocharger 14.

According to another aspect of the present invention, an inventive method avoids the costly process of connecting external plumbing to a turbocharger within the confines of an engine production line. Rather, turbocharger 14 is pre-assembled to utility pedestal 18 at a location which is separated from the production line. Then, the assembly including the turbocharger and the pedestal may be easily mounted upon the engine without the necessity of connecting any external cooling or lubrication plumbing.

Figure 7:
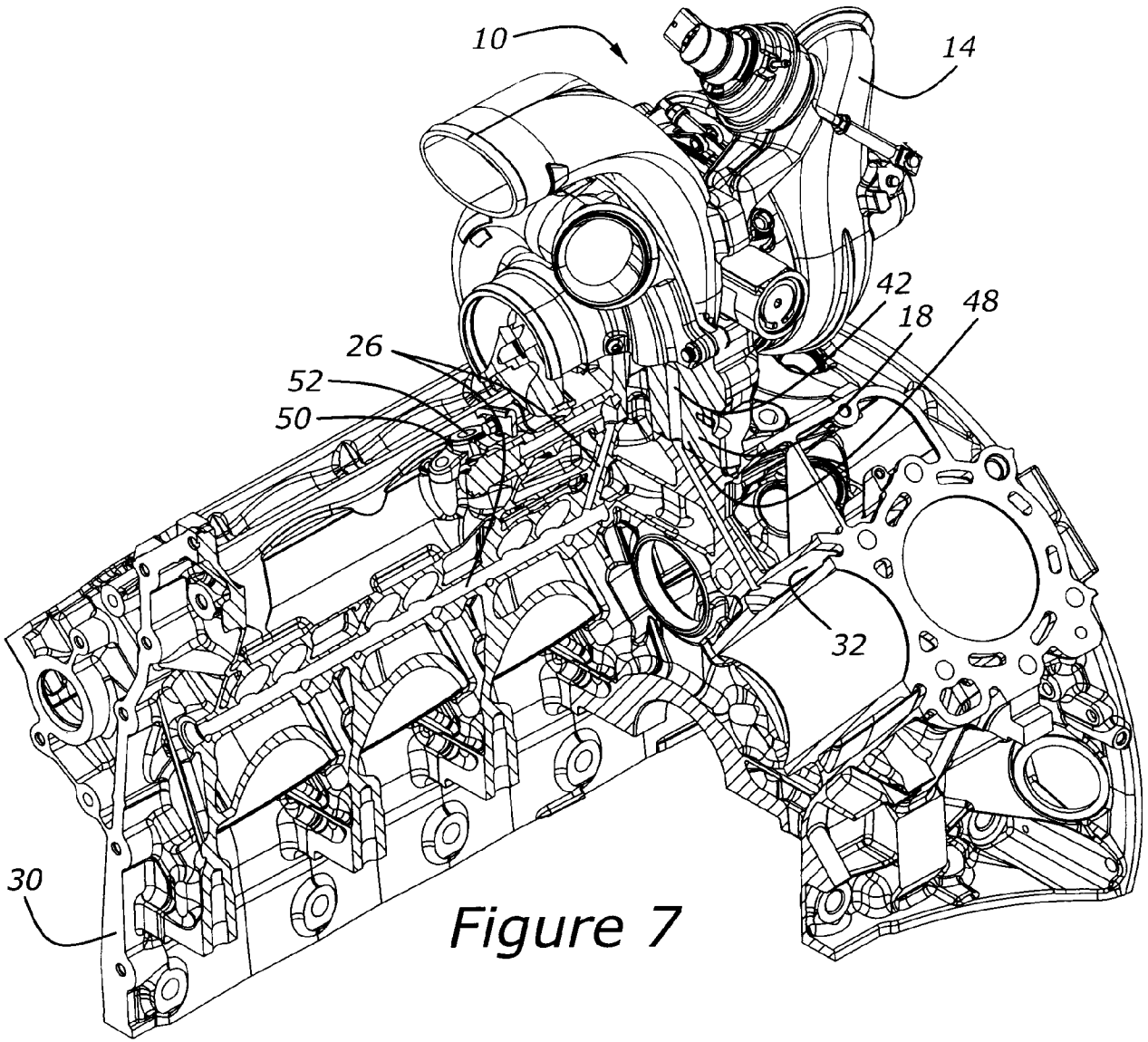
FIG. 7 is similar to FIG. 5, but shows a one-piece utility pedestal and turbocharger combination.

In contrast with FIGS. 4 and 5, which show turbocharger 14 as being attached to a separate pedestal, 18, FIG. 7 shows turbocharger 14 as being one piece with pedestal 18. For certain high production volume applications of a turbocharging system according to the present invention it may be advantageous to integrate pedestal 18 with turbocharger 14 in the manner of FIG. 7. However, for applications of the present invention for which lower production volumes are the rule, it is probably equally advantageous to provide a separate, more easily modifiable, separate pedestal having the characteristics of FIGS. 4 and 5.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A turbocharger system for an engine, comprising:

a turbocharger; and a utility pedestal positioned vertically between the turbocharger and a hard point that extends laterally between opposing cylinder banks and is located on a mid-portion of a cylinder block, said utility pedestal for connecting the turbocharger to internal utility passages within the engine, said utility pedestal comprising:

a mounting pad;

an internal oil supply passage; and an internal coolant supply passage.

2. A turbocharger system according to claim 1, further comprising a coolant return passage, configured at least in part within said utility pedestal, for conveying coolant from the turbocharger to a cooling system incorporated within the engine.

3. A turbocharger system according to claim 2, wherein said coolant return passage comprises a passage configured, at least in part, within the cylinder block as well as within the utility pedestal.

4. A turbocharger system according to claim 2, wherein said coolant return passage comprises a passage configured, at least in part, within the cylinder block, with said coolant return passage conveying coolant to a mixing chamber within which coolant from the turbocharger is mixed with coolant from at least one cylinder head.

5. A turbocharger system according to claim 1, further comprising a return oil passage, within said pedestal, for conveying waste oil from the turbocharger to a crankcase sump.

6. A turbocharger system according to claim 1, wherein said utility pedestal is formed as one-piece with said turbocharger.

7. A turbocharger system according to claim 1, wherein said utility pedestal is formed separately from said turbocharger.

8. A turbocharger system according to claim 1, further comprising a gasket interposed between the mounting pad and the hard point positioned on the cylinder block of the engine, with said gasket comprising a unitary carrier having a plurality of integral o-ring seals.

9. A process for providing a turbocharger on an engine, comprising:

assembling a turbocharger to a utility pedestal, with said pedestal comprising a mounting pad and lubricating oil and coolant passages; and bolting the turbocharger and pedestal to an engine, while simultaneously securing oil and coolant supply connections between the pedestal and the engine without connecting any external cooling or lubrication plumbing; and coupling the mounting pad of the utility pedestal to a hard point that is positioned on a cylinder block of the engine, the hard point located within a valley defined by the cylinder block and at least two cylinder heads of the engine, the hard point extending laterally between a first cylinder head and an opposing second cylinder head.

10. A process according to claim 9, wherein said turbocharger is assembled to said utility pedestal at a first geographic location, with said assembled turbocharger being mounted to the engine at a second geographic location which is different from the first location.

11. An engine, comprising:

a V-block configured cylinder block;

a plurality of cylinder heads attached to said cylinder block, with said cylinder heads and said cylinder block defining a valley between the cylinder heads;

a hard point configured upon said cylinder block within said valley, the hard point extending laterally between opposing cylinder heads of the cylinder block; and a turbocharger mounted upon a utility pedestal that is positioned between the turbocharger and a hard point located on the cylinder block within the valley, with said utility pedestal comprising:

a mounting pad for the pedestal, with said mounting pad having a plurality of mounting bosses with fastener bores extending therethrough;

an internal oil supply passage for conveying lubricating oil, under pressure from an internal oil passage in the cylinder block, to the turbocharger; and an internal coolant supply passage for conveying coolant, under pressure within an internal coolant passage, to the turbocharger.

12. An engine according to claim 11, further comprising a coolant return passage, configured at least in part within said utility pedestal, for conveying coolant from the turbocharger to a cooling system incorporated within the engine.

13. An engine according to claim 11, further comprising a return oil passage, internal to said pedestal, for conveying lubricating oil from the turbocharger to a lubrication system incorporated within the engine.

14. A turbocharger system according to claim 1 wherein the internal oil supply passage conveys lubricating oil under pressure from the engine to the turbocharger.

15. A turbocharger system according to claim 1 wherein the internal coolant supply passage conveys coolant under pressure from the engine to the turbocharger.

16. The turbocharger system according to claim 1, wherein the engine is a V-block engine and the hard point is seated within a valley defined by the cylinder block and at least two cylinder heads of the V-block engine, the hard point located laterally between a first cylinder head and a second cylinder head.

17. The turbocharger system according to claim 1, wherein the hard point is located between block end walls and within a block valley, the engine a V-engine.

18. The engine according to claim 11, wherein the hard point is located laterally between a first cylinder head and a second cylinder head and in a mid-portion of the valley between block end walls.

* * * * *